United States Patent [19]

Swartzendruber

[11] 4,159,782

[45] Jul. 3, 1979

[54] BANKING MACHINE CONTROL

[75] Inventor: Robert F. Swartzendruber, Plano, Tex.

[73] Assignee: Docutel Corporation, Irving, Tex.

[21] Appl. No.: 792,930

[22] Filed: May 2, 1977

[51] Int. Cl.[2] ..... B65H 7/14; B65H 7/12; B65H 29/60

[52] U.S. Cl. ..... 221/1; 221/13; 221/21; 221/191; 271/4; 271/64; 271/122; 271/259; 271/263

[58] Field of Search ..... 271/4, 263, 262, 259, 271/258, 213, 110, 111, 118, 122, 34, 64, 199, 202; 93/93 C; 194/DIG. 26; 221/13, 21, 191, 218, 1

[56] References Cited

U.S. PATENT DOCUMENTS

| | | | |
|---|---|---|---|
| 3,767,080 | 10/1973 | Erickson | 221/13 |
| 3,795,395 | 3/1974 | Ransom et al. | 271/263 X |
| 3,870,295 | 3/1975 | Kukucka | 271/173 |
| 3,937,453 | 2/1976 | Hickey et al. | 271/263 X |
| 3,988,017 | 10/1976 | Kyhl | 271/259 X |
| 4,020,972 | 5/1977 | Lundblad | 221/13 |

*Primary Examiner*—Bruce H. Stoner, Jr.
*Attorney, Agent, or Firm*—Richards, Harris & Medlock

[57] ABSTRACT

Bank notes are accurately delivered to a customer in a preselected amount at an exit throat from a storage bin. Delivery of the bank notes from the storage bin is on an individual basis to an escrow station where the number of bills of currency representing the preselected amount is collected for delivery to the customer at the exit throat. In the transport path from the storage bin to the escrow station multiple bank notes and trailing bank notes are detected to control the operation of the banking machine to deliver the notes at the escrow station either to the customer or divert a miscount of the bank notes to a divert bin. Initially, the process for transporting bills from the storage bin to the escrow station actuates a main drive motor of a transport system. Bank notes are fed from the storage bin to the transport system and if more than one bill is fed to the transport system all but one are returned to the storage bin. The travel time of a note past a check point is monitored to determine an overlapping note condition. Multiple bank notes traveling together through the transport system are sensed after completion of the timing function. Bank notes delivered from the transport system are assembled in an escrow station for a subsequent transporting to the exit throat.

19 Claims, 6 Drawing Figures

BANKING MACHINE CONTROL

Figure 1:
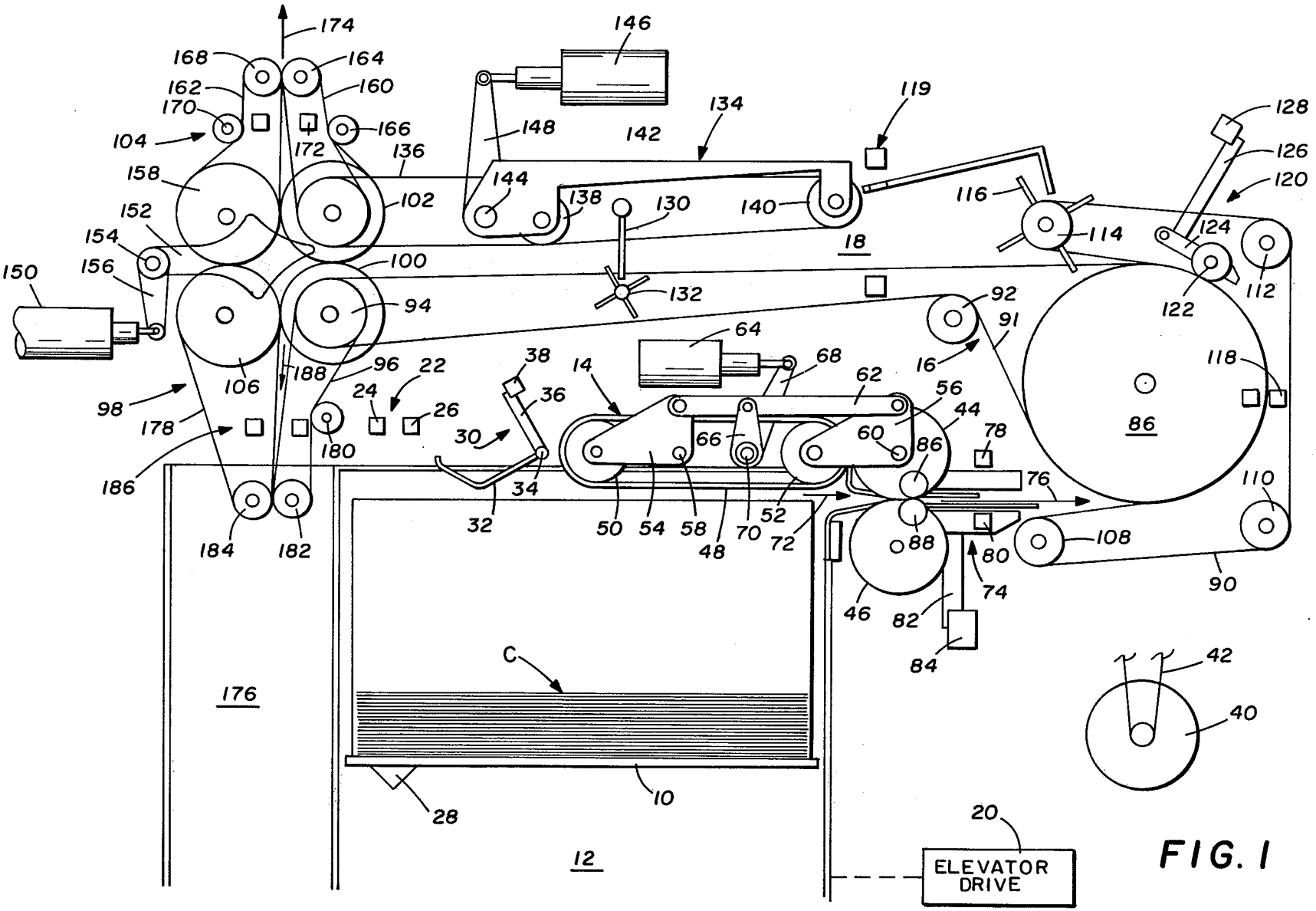

This invention relates to a banking machine, and more particularly to apparatus and the method of controlling the dispensing of bank notes from a banking machine.

Recent studies have shown that the general public is relying more heavily on the use of automatic banking machines to complete their financial transactions. There are many reasons advanced for this change from conventional banking for completing financial transactions to the use of automatic banking machines. One significant advantage, however, of the automatic banking machine is its availability on a twenty-four hour basis. The convenience of twenty-four hour availability, as well as the capability of being operated at numerous locations, where such service would otherwise not be feasible, is possible because such machines are self-operated in that they function on the command of the customer. Although such banking machines are "self-operating", the system must be accurate, error free and capable of dispensing bank notes upon command by the customer in a convenient form and in quantities selected by the customer.

Many prior art bank note dispensing machines provide for the successive counting out of bank notes from a currency storage location. Others merely dispense a selected number of bills to a drawer which is subsequently opened to the customer to permit withdrawal of the currency. These systems permit selected withdrawal of varied amounts of currency, but do not provide an accurate method of control of the currency being paid out in that once a bank note is dispensed there is no means of retracting the note where an error in dispensing has been made.

It will be evident that the reliability of a banking machine is of importance particularly when the dispenser is self-operating and unattended in any direct manner. Considerable inconvenience may be caused to a customer if a banking machine fails to operate upon the presentation of a customer identification card as a result of a malfunction of the system.

It is also evident that only the correct quantity of bank notes should be delivered to the customer for such automatic banking machines to be acceptable. A banking machine dispensing bank notes must operate to minimize the possibility of delivering more bank notes to the customer than selected. Prior art systems utilized a "fail safe" device that shut down the apparatus upon the detection of a misfeed, but such a solution causes obvious inconvenience and loss of service of the machine.

A feature of the present invention is to provide a bank note dispensing control that reliably and accurately dispenses bank notes from a storage bin to a customer at an exit throat. Individual bills are fed from the storage bin to a transport that selectively returns all but one bank note to the storage bin and transports only a single bill to an escrow station. The travel time of a bank note through the transport is monitored to detect the condition when bills are traveling together in a trailing configuration through the transport system. A second multiple bill evaluation is made as a bank note enters the escrow station.

Another feature of the present invention is to deliver all bills in the escrow station to a customer when the correct number has been assembled. When either a trailing bill condition is detected or multiple bills are detected after completion of the timing function, all bills in the escrow station are diverted to the divert bin. This system, however, will resume normal functioning after the divert cycle.

In accordance with the present invention, the method of controlling the dispensing of bank notes from a banking machine responsive to externally generated control signals includes the initial step of actuating a main drive motor of a transport system that delivers currency from a storage bin to an escrow station. Bills are fed from the storage bin to the transport system and all but one bill is returned back to the storage bin. Subsequently, as the bill travels past a check point, the travel time is monitored to detect an overlapping bill condition. Following this timing function, multiple bills traveling together through the transport system are sensed. Bank notes delivered from the transport system are assembled in an escrow station, and when all the bank notes have been assembled they are transported as a group from the escrow station to an exit throat.

Apparatus of the present invention for controlling the dispensing of currency from a banking machine responsive to externally generated control signals includes a transport for delivering bank notes from a storage bin to an escrow station. A bill feeder extracts bills from the storage bin and feeds them to the transport. A first multiple bill detector responds to the movement of bills in the transport and generates a separating signal when more than one bill enters the transport. A bill separator responds to the separating signal to return all but one bill fed to the transport back into the storage bin. Downstream of the first multiple bill detector a sensor monitors the movement of bills through the transport and generates a bill timing and bill count signal. A second multiple bill detector downstream of the sensor responds to multiple bills traveling together through the transport to generate a divert signal at the termination of the bill timing signal. Bills assembled in the escrow system are transported to an exit throat at the termination of the bill count signal if the second multiple bill detector does not sense multiple bills traveling together.

For a more complete understanding of the present invention and the advantages thereof, reference is now made to the following description taken in conjunction with the accompanying drawings.

Figure 2A:
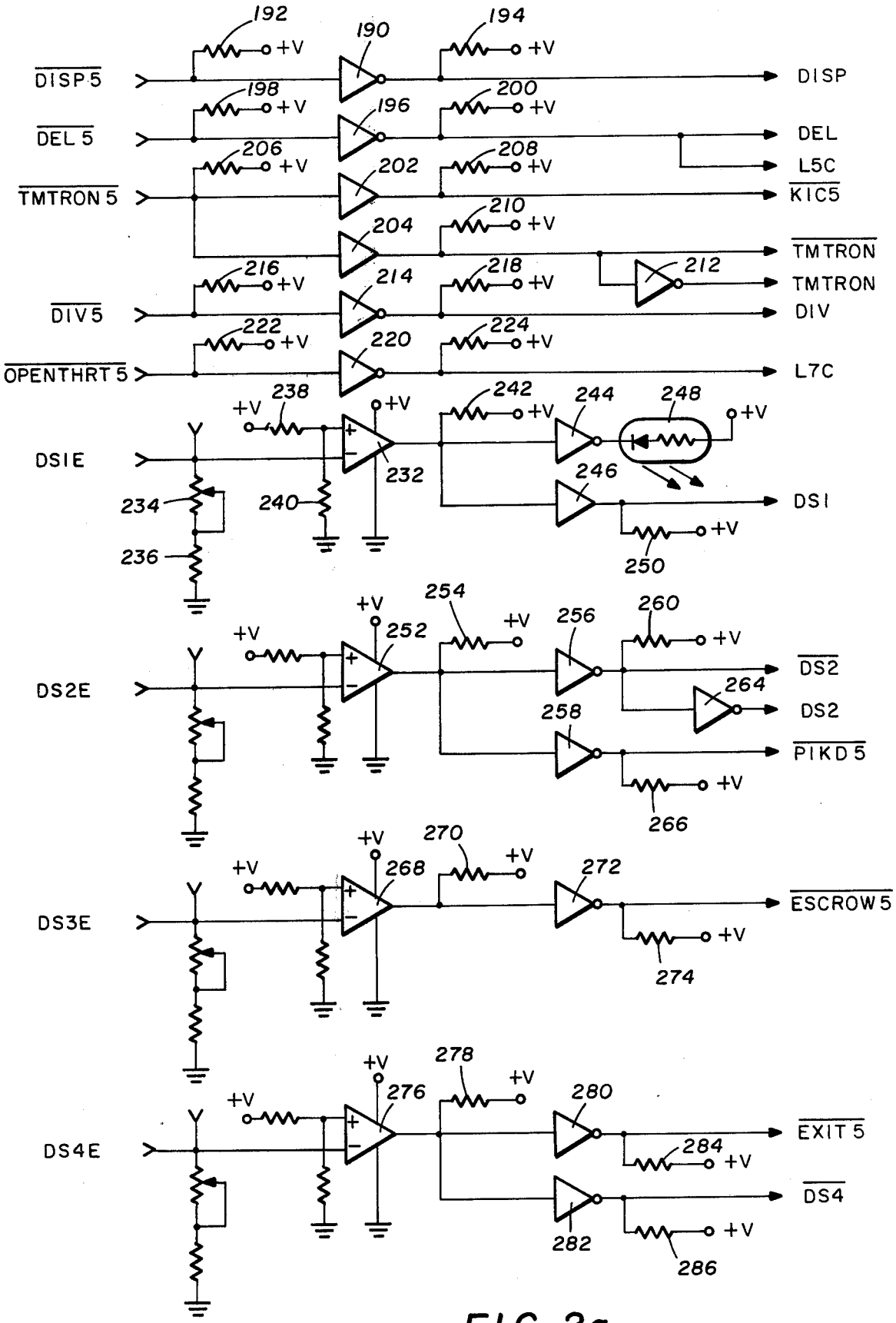
Figure 2B:
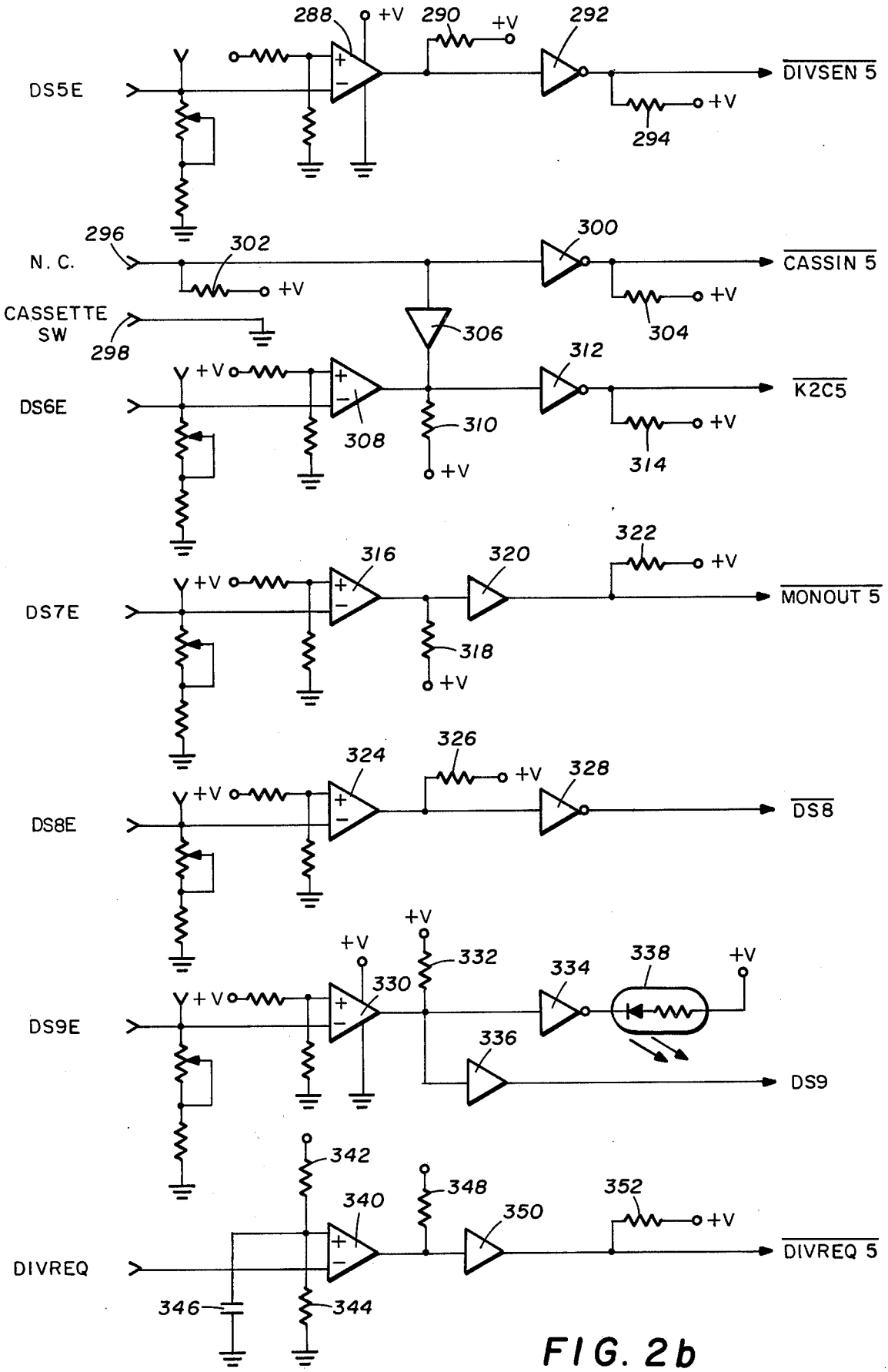
Figure 3:
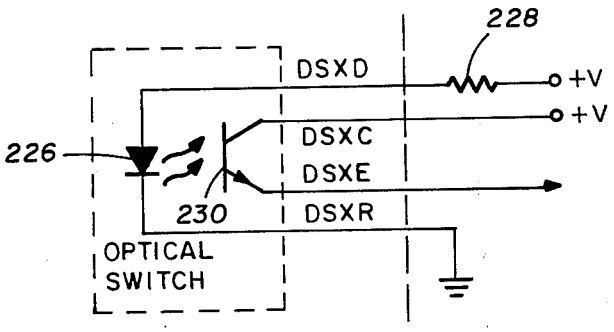
Figure 4A:
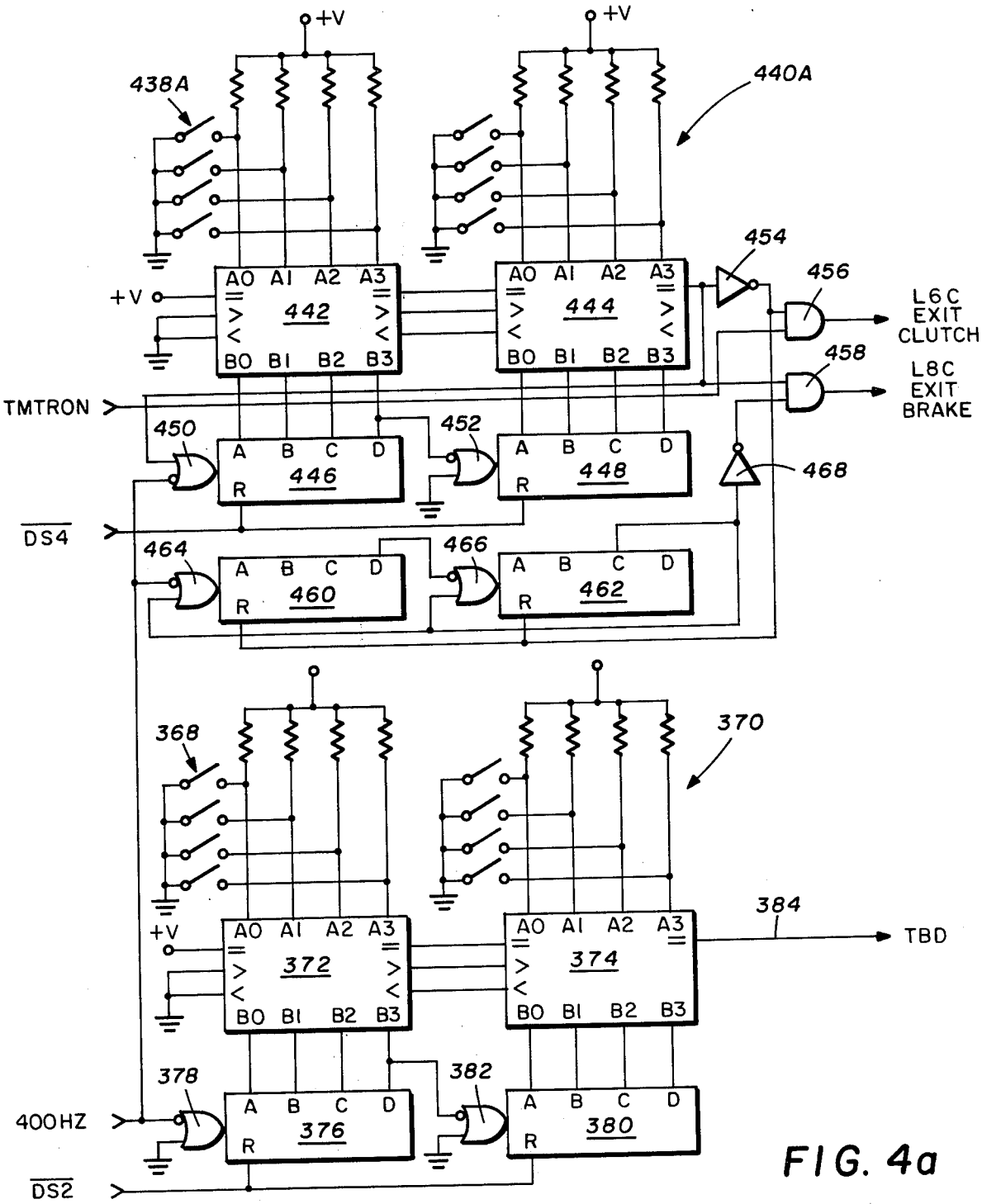
Figure 4B:
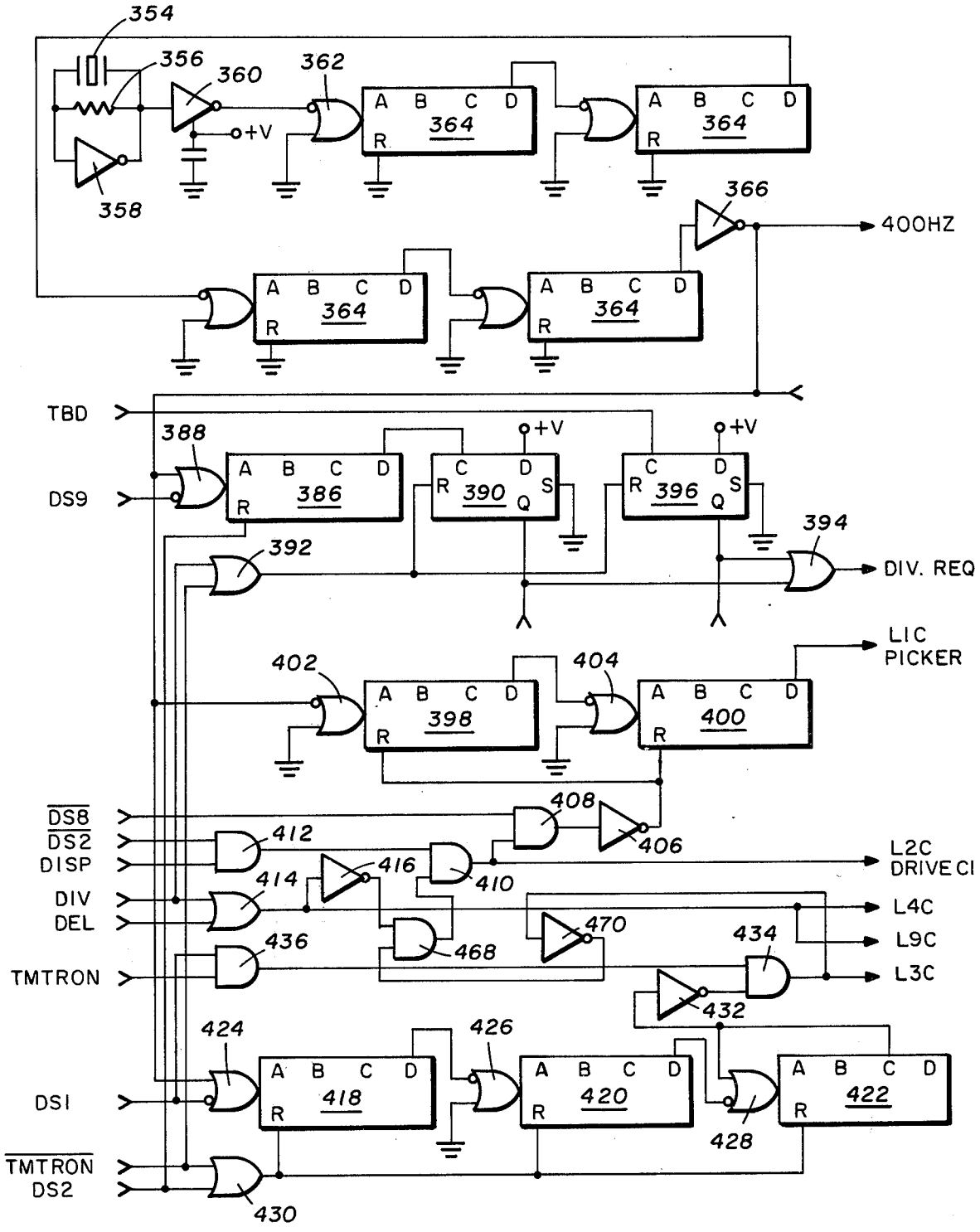

Referring to the drawings:

FIG. 1 is a schematic of a bank note dispensing system for an automatic banking machine for delivering bank notes from a storage bin to an exit throat via an escrow station;

FIGS. 2*a* and 2*b* are schematics for converting sensor signals into processing data signals;

FIG. 3 is a circuit schematic for interfacing an optical switch to processing logic; and FIGS. 4*a* and 4*b* are logic diagrams for processing the data signals to actuate the control elements of the transport of FIG. 1.

Referring to FIG. 1, bank notes C on an elevator 10 as part of a removable storage bin 12 are delivered by means of a picker assembly 14 through a continuous belt transport 16 to an escrow station 18. Positioning of the elevator 10 is achieved by means of mechanical linkage (not shown) connected to an elevator motor 20 selectively controlled to position the bank notes C to the top of the storage bin 12 and in a position to be in delivery through the sensing apparatus.

An optical detector 22 detects the presence or absence of bank notes C on the elevator 10 and provides signals to a control unit to shut down operation of the apparatus when the storage bin 12 is empty of bank notes. The detector 22 includes a light source 24 and a light responsive photosensor 26 for detecting the reflection of light from the light source and thereby determining the presence or absence of bank notes on the elevator 10. When bank notes are present on the elevator 10 light emitted from the light source 24 is absorbed by the bank notes and therefore undetected by the photosensor 26. However, a portion of the elevator 10, immediately opposite the light sensor 24 and the photosensor 26, includes a ninety degree included angle mirror 28 such that light emitted from the light source is reflected onto the photosensor whenever there are no bank notes C on the elevator 10. Therefore, whenever the photosensor 26 detects light as a result of the reflection from the mirror 28 a signal is transmitted to an external controller to shut down operation of the dispenser apparatus.

Control of the elevator drive motor 20 to impart upward movement of the elevator 10 as bank notes are dispensed is provided from a bill position sensor 30. Briefly, the bill position detector 30 includes an arm 32 supported for rotation about a shaft 34 and attached to a vane 36. The vane 36 is positioned to move between a detector 38 comprising a light emitting diode and a photosensor. As the bank notes C drop below a predetermined level, the arm 32 and thus the vane 36 rotates counterclockwise and the detector 38 generates a signal to a controller for actuating the elevator motor 20. In this way, the elevator 10 is maintained in position to continuously provide bank notes for delivery to the belt transport 16.

To deliver bank notes C from the storage bin 12 the initial step is to actuate a drive motor 40 coupled to the belt transport 16 by means of a drive belt 42. The main drive motor 40 also actuates the picker assembly 14 through a roller 44 of a separating roller pair including a roller 46. The roller 44 drives the picker assembly 14 by contact with a flat belt transport 48 rotating with rollers 50 and 52. Spaced triangular shaped arms 54 and 56 support the rollers 50 and 52, respectively. The triangular shaped arm 54 rotates on a shaft 58 and the triangular shaped arm 56 rotates on a shaft 60 that also supports the roller 44. Interconnecting the triangular shaped arms 54 and 56 is a linkage 62 coupled to a solenoid driver 64 through linkage arms 66 and 68. The linkage arm 66 is pivoted about a shaft 70.

To feed bank notes C from the elevator 10 into the nip of the rollers 44 and 46, the solenoid 64 is actuated to rotate the picker assembly about the shafts 58 and 60 and bring the flat belt transport 48 into contact with the bank notes. The flat belt transport 48 is driven in a counterclockwise direction and delivers bank notes in the direction of the arrow 72 into the nip of the rollers 44 and 46.

A mechanical doubles detector 74 is mounted immediately downstream of the separator rollers 44 and 46 and is positioned such that bank notes passing through the rollers 44 and 46 in the direction of an arrow 76 pass through the double detector. Also located in the area of the doubles detector 74 is an optical detector including a light emitting diode 78 and a photosensor 80. These elements are positioned on opposite sides of the bank note travel path as indicated by the arrow 76. When a bank note passes into the optical detector a signal is generated to deenergize the solenoid 64.

Briefly, the doubles detector 74 includes a vane 82 pivotally mounted to rotate between a sensor 84. Motion is imparted to the vane 82 when a bank note passes through detector rollers 86 and 88. Any movement of the vane 82 when more than one bill passes through the rollers 86 and 88 is detected by the sensor 84 that includes a light emitting diode and a photosensor. Movement of the vane 82 by two or more bills prevents light from the diode from being detected by the photosensor and a signal is generated to a controller for actuating clutch assemblies for selectively connecting the rollers 44 and 46 to the drive motor 40. When multiple bills are detected passing through the detector rollers 86 and 88, the clutch for the roller 46 is energized to drive this roller backwards to separate bills in the transport. At the same time, the clutch for the roller 44 is deenergized and it is no longer driven. However, the roller 44 is prevented from rotating clockwise (normal rotation is counterclockwise), thereby presenting the condition that the roller 44 is nonrotating and the roller 46 is rotating in a counterclockwise direction. By stopping the roller 44 and driving the roller 46 counterclockwise, a scrubbing action is produced that separates bank notes that may be adhering together.

When the vane 82 no longer interrupts the light path of the sensor 84 the clutch for the roller 46 is deenergized thereby disconnecting this roller from the drive motor 40 and the clutch for the roller 44 reengages the drivable connection to the motor 40. The single bill is now driven in the direction of the arrow 76 to the continuous belt transport 16.

As illustrated, the transport 16 includes a main drive roller 86 providing power to continuous belts 90 and 91, each of these continuous belts moving in the path determined by idler rollers. For the continuous belt 91, the travel path is determined by an idler roller 92 and an idler roller 94 which also guides a continuous belt 96 of a divert bin transport 98. The roller 94 is supported on a shaft also carrying a pinch roller 100 that is in engagement with a pinch roller 102 as part of an exit throat transport 104. The pinch roller 100 also forms a pair with a pinch roller 106 as part of the divert bin transport 98.

With regard to the continuous belt 90, it has a travel path established by idler rollers 108, 110, 112 and 114, the latter mounted on a shaft supporting a paddle wheel 116 for positioning a bank note in the escrow station 18.

A bank note entering the transport 16 is driven between the belts 90 and 91 and subsequently passes through a detector 118 comprising a light emitting diode and a photosensor. As the bill passes through the detector 118 a signal is generated to deenergize clutches driving the pinch roller 44 and the bank note is now driven only by the continuous belts 90 and 91. Also, at this time a timing function is initiated by the leading edge of a bank note passing through the detector 118. Since the length of the bank note is known, the time required for it to completely pass through the detector 118 may be calculated. Thus, after a preset time the bank note should have cleared the detector 118. If a bank note is still passing through the detector 118 after this preset time interval, the indication is that there is a trailing bill condition, that is, a second bill is immediately following the first through the continuous belts 90 and 91.

When the note being dispensed clears the detector 118, the pinch roller 44 is reenergized and if the optical detector of diode 78 and sensor 80 is not covered, then the solenoid 64 is also reenergized.

Downstream of the detector 118 there is located a multiple bill detector 120 consisting of a roller 122 mounted to a pivoted arm 124 that in turn is connected to a vane 126. The vane 126 passes through a detector 128 which consists of a light emitting diode and a photosensor. As a bill passes under the roller 122, it deflects the vane 126 by an amount depending on the thickness of the bill. The vane-detector relationship is such that if only one bill is passing under the roller 122, light from the diode will be detected by the photosensor. However, should more than one bill pass under the roller 122 at the same time, the vane 126 will interrupt the light beam to the photosensor and the detector 128 generates a double bill signal. To avoid generating a double signal from the detector 128 for a bill having a leading edge fold, the signal from the detector 128 is disregarded until the bank note has cleared the detector 118. Thus, the multiple bill detector 120 only becomes operational after a bill has cleared the detector 118.

Each bill delivered from the storage bin 12 to the belt transport 16 exits the belt transport at the paddle wheel 116 and is assembled in the escrow station 18. The number of bills passing through the transport 16 is counted by the detector 118, and when the selected number of bills has been assembled into the escrow station 18, these bills are delivered to a customer.

At the escrow station 18, there is included a solenoid operated gate 130 that retains the bills in the escrow station during the assembly process. To properly assemble the bank notes at the escrow station a leading edge paddle wheel 132 rotates with the paddle wheel 116.

Bank notes assembled in the escrow station 18 are delivered to the exit throat transport 104 by a continuous belt transport 134. This transport includes a continuous belt 136 driven by a pulley rotating with the pinch roller 102. The travel path of the continuous belt 136 is further defined by idler pulleys 138 and 140 supported on a frame 142 that is rotated on a shaft 144 by means of a solenoid 146. The solenoid 146 is coupled to the frame 142 by means of linkage 148.

When the correct number of bills has been assembled in the escrow station 18, and they are ready to be delivered to a customer, a solenoid 150 is energized to rotate a divert gate 152 into a position to allow bills from the escrow station 18 to be delivered to the exit throat transport 104. The divert gate 152 is pivoted on a shaft 154 and coupled to the solenoid 150 by means of a linkage 156. Next, a signal is applied to the solenoid controlling the gate 130 to rotate the forward stop of the escrow station into a bill delivery position. At the same time, a signal is applied to the solenoid 146 to rotate the continuous belt 136 in contact with the continuous belt 91 thereby providing driving power for the assembled bills to be delivered to the exit throat transport 104.

In the exit throat transport 104, the bills enter a pinch roller pair consisting of the roller 102 and a roller 158. Also rotating with the rollers 102 and 158 are continuous belts 160 and 162. The continuous belt 160 rotates in the path defined by idler rollers 164 and 166 while the continuous belt 162 travels in a path defined by idler rollers 168 and 170.

As the bundle of bills from the escrow station 18 passes through the exit throat transport 104, the bundle passes through a detector 172 consisting of a light emitting diode and a photosensor. As the leading edge of the bundle passes through the detector 172, a timing function is initiated. At the end of the time delay a clutch controlling the operation of the roller 158 is deenergized and a brake associated with this roller is energized to stop the forward progress of the bundle as it moves in the direction of the arrow 174. When the customer removes the bundle from the transport 104, the detector 172 is uncovered indicating that the transaction is complete and the system shuts down.

If a double is detected at the doubles detector 120 or if a trailing bill condition is sensed by the detector 118, the bills assembled in the escrow station 18 are transported to a divert bin 176. To divert bills from the escrow station 18 into the divert bin 176, the solenoid 150 remains deenergized thereby holding the divert gate 152 in the position shown, the gate 130 is rotated from its end position, and the solenoid 146 is energized to rotate the continuous belt 136 in contact with the continuous belt 91.

Bills in the escrow station 18 now pass through the pinch rollers 100 and 102 and are diverted by the gate 152 into pinch rollers 100 and 106. These bills now enter the divert bin transport 98 which consists of, in addition to the continuous belt 96, a continuous belt 178. The continuous belt 96 travels in the path established by idler rollers 180 and 182 while the continuous belt 178 travels in a path set by the idler roller 184.

Bills passing through the divert bin transport 98 in the direction of the arrow 188 pass through a detector 186. This detector senses when the last bill has cleared the light beam from a light emitting diode to a photosensor and generates a signal to begin again assembling the desired number of notes in escrow.

For a more complete description of the dispense system of FIG. 1, reference is made to the copending application of Richard C. Hickey, entitled "Document Dispenser with Escrow System", filed Feb. 4, 1977, Ser. No. 765,827, and assigned to the assignee of the present invention.

The control system of the present invention for operating the dispenser of FIG. 1 receives basic command signals from a central controller, such controller not forming a part of the present invention. This central controller may be part of an overall banking machine that accepts inputs from a customer identifying the amount of bank notes to be dispensed. After preliminary verification checks have been made and the system is ready to dispense bank notes by the apparatus of FIG. 1, the central controller generates various commands to the control apparatus of the present invention.

Referring to FIGS. 2*a* and 2*b*, there is shown circuitry for converting command signals from a central controller into control signals for the system of the present invention. Command signals from the central controller are as follows:

Turn on Transport Motor ($\overline{\text{TMTRON5}}$),
Dispense Bills to Escrow Station ($\overline{\text{DISP5}}$),
Deliver Bills in Escrow to Exit Throat ($\overline{\text{DEL5}}$),
Divert Bills in Escrow to Divert Bin ($\overline{\text{DIV5}}$), and
Open Dispenser External Throat ($\overline{\text{OPENTHRT5}}$).

The latter is a signal not directly related to the control system of the present invention, but rather is a signal controlling the actuation of a solenoid at an exit gate. This exit gate would be downstream of the arrow 174 of FIG. 1.

The $\overline{\text{DISP5}}$ command is applied to an inverter amplifier 190 biased at the input by means of a resistor 192 and at the output by means of a resistor 194. A dispense control signal (DISP) is generated at the output of the inverter amplifier 190. The command to deliver bills ($\overline{DEL5}$) is applied to an inverter amplifier 196 biased at the input by means of a resistor 198 and at the output by means of a resistor 200. An output from the inverter amplifier 196 is a deliver control signal (DEL) and a divert gate control signal (L5C). The command to turn on the transport motor 40 ($\overline{TMTRON5}$) is input to the amplifiers 202 and 204, both inputs biased by means of a resistor 206. The amplifier 202 is biased at the output by means of a resistor 208 and generates a control signal ($\overline{KIC5}$). An output of the amplifier 204 is biased by a resistor 210 and generates a motor control signal ($\overline{TMTRON}$) that is applied to an inverter amplifier 212 to generate the motor control signal (TMTRON). A command ($\overline{DIV5}$) to divert the bills assembled in the escrow station 18 is input to an inverter amplifier 214 that is biased at the input by a resistor 216 and biased at the output by a resistor 218. The output of the inverter amplifier 214 is the divert control signal (DIV). The open throat command ($\overline{OPENTHRT5}$) is applied to an inverter amplifier 220 biased at the input by a resistor 222 and at the output by a resistor 224. The output of the inverter amplifier 220 is the control signal (L7C) for energizing the solenoid controlling the exit gate, as described.

Also shown in FIGS. 2*a* and 2*b* are circuits for converting the outputs of the various detectors into logic level signals. Referring to FIG. 3, there is schematically shown a circuit for each of the optical detectors of FIG. 1. Each detector includes a light emitting diode 226 biased from a positive voltage source through a resistor 228. Light emitting from the diode is detected by a photosensor 230 having an electrode connected to a positive DC supply and an emitter electrode connected to a bias circuit at the input of a biased differential amplifier, as shown in FIGS. 2*a* and 2*b*. As illustrated in FIG. 3, the signal (DSXE) is the output of each of the optical detectors of the control system for the apparatus of FIG. 1 where the letter "X" is the number identifying a particular detector.

With reference to the detector 84, the DS1E signal from the photosensor is applied to the inverting input of an amplifier 232 that is biased by an adjustable network comprising resistors 234 and 236. The noninverting input of the amplifier 232 is biased by means of a divider network of resistors 238 and 240. An output of the amplifier 232 is biased by a resistor 242 and applied to inputs of inverter amplifier 244 and noninverting amplifier 246. The output of the inverter amplifier 244 drives a light source 248. The output of the amplifier 246 is biased by a resistor 250 and generates the control signal DS1.

The output of the detector 118 is the signal DS2E applied to the inverting input of an amplifier 252 with input biasing circuits similar to the amplifier 232. The output of the amplifier 252 is biased by a resistor 254 and applied to inverter amplifiers 256 and 258. The output of the inverter amplifier 256 is biased by a resistor 260 and is the control signal $\overline{DS2}$. The output of the inverter amplifier 256 is also applied to an inverter amplifier 264 that provides the control signals DS2. An output of the inverter amplifier 258 is biased through a resistor 266 and generates the control signal $\overline{PIKD5}$.

The output of a detector 119 at the escrow station 18 is a signal DS3E applied to the input of an amplifier 268 having an input biasing circuit similar to the amplifier 232. The output of the amplifier 268 is biased through resistor 270 and applied to an inverter amplifier 272 that in turn is biased through a resistor 274 and generates the control signal $\overline{ESCROW5}$.

At the exit throat transport 104, the output of the detector 172 generates the signal DS4E applied to an amplifier 276 with input biasing circuits similar to the amplifier 232. The output of the amplifier 276 is biased through a resistor 278 and applied to inverter amplifiers 280 and 282. The amplifier 280 has an output biased through resistor 284 and generates the control signal $\overline{EXIT5}$. The output of the amplifier 282 is biased through a resistor 286 and generates the control signal $\overline{DS4}$.

The output of the photosensor for the detector 186 at the divert bin transport 98 is the signal DS5E applied to the input of an amplifier 288 having input biasing circuits similar to the amplifier 232. The output of the amplifier 288 is biased through a resistor 290 and inverted in an amplifier 292 that in turn is biased by a resistor 294 and generates the control signal $\overline{DIVSEN5}$ as an indication of a divert action.

To ensure that the storage bin 12 is in place as shown in FIG. 1, a contact switch (not shown) is provided. This contact switch is interconnected between the terminals 296 and 298 and a contact closure provides an input to an inverter amplifier 300 at a value determined by the resistor 302 and the position of the switch. The output of inverter amplifier 300 is biased through resistor 304 and provides a status signal $\overline{CASSIN5}$ indicating that the storage bin 12 is in place. The voltage generated across the resistor 302 is also applied to an input of an amplifier 306.

Also with reference to the storage bin 12, an output of the detector 38 is the signal DS6E applied to the input of an amplifier 308 having input biasing circuits similar to the amplifier 232. The output of the amplifier 308 is wire OR'd with the output of the amplifier 306 at a junction with a resistor 310 and the summation voltage is applied to the input of an inverter amplifier 312. The output of the amplifier 312 is biased through a resistor 314 and generates the control signal $\overline{K2C5}$.

An output of the detector 22 is the signal DS7E applied to the input of an amplifier 316 having the same input biasing circuits as previously described and with an output generated across a resistor 318 and applied to an amplifier 320. A resistor 322 establishes the level of the output voltage of the amplifier 320 and this voltage is a control signal $\overline{MONOUT5}$ which is generated when all the bank notes on the elevator 10 have been dispensed.

Immediately downstream of the separator rollers 44 and 46 is the detector 78 providing the signal DS8E to the input of an amplifier 324, again with input biasing circuits as described with reference to the amplifier 232. An output of the amplifier 324 is biased through resistor 326 and applied through an inverter amplifier 328 that generates the control signal $\overline{DS8}$.

Downstream of the detector 118 double bills are detected at the multiple bill detector 128 that includes a photosensor 128 generating the signal DS9E input to an amplifier 330 that has an output biased by a resistor 332 and applied to inverter amplifier 334 and noninverting amplifier 336. Amplifier 334 drives a light source 338 and the output of the amplifier 336 is the control signal DS9.

Divert required ($\overline{DIVREQ5}$) is a status bit presented to the central controller. DIVREQ is generated by a circuit which will be described later and is applied to the input of an amplifier 340 whose second input is connected to a bias network including resistors 342 and 344 and a capacitor 346. The output of the amplifier 348 is biased by means of a resistor 348 and applied to the input of an amplifier 350. The output of the amplifier 350 is biased by means of a resistor 352 and generates the status signal $\overline{\text{DIVREQ5}}$.

Referring to FIGS. 4*a* and 4*b*, control signals generated by the circuitry of FIGS. 2*a* and 2*b*, and not followed with the logic level designator "5", are applied to timing logic to control the various control elements of the apparatus of FIG. 1. There are six timing functions in the operation of the apparatus of FIG. 1; these include:

1. The length of time a bank note is passing the detector 118,
2. The length of time a double note is detected at the doubles detector 120,
3. The time required to deliver a bundle of notes from the detector 172 to the exit throat,
4. The length of time that the brake is energized for the roller 158,
5. The time for scrubbing action produced by the rollers 44 and 46, and
6. Controlling the energization of the solenoid 64.

The first three of these functions require accuracy and repeatability and this is provided by a crystal oscillator including a crystal 354 in parallel with a resistor 356 connected with an inverting amplifier 358 to form an oscillator. A periodic signal at the output of the amplifier 358 is applied to an inverting amplifier 360 having an output connected to a NOR gate 362. The frequency established by the crystal 354 is divided by four decade counters 364 with the last counter in this chain applied to the input of an inverter amplifier 366. The output frequency of the amplifier 366 may typically be 400 Hz. This frequency signal is the clock applied to various timing networks of the control system of the present invention.

With regard to the trailing bill detector 118, the amount of time it takes a bill to travel past this detector is used to determine a trailing bill condition. This time varies with the length dimension of the bank notes in the storage bin 12 and is programmable by means of switch banks 368 and 370. Voltages established across the resistors of these networks are input to one side of digital comparators and represent a particular count, related to note length. Specifically, the switch bank 368 connects to digital comparator 372 and the switch bank 370 connects to digital comparator 374. The count compared with those established by the switch bank 368 is generated in a counter 376 receiving the clock frequency through a gate 378. The count compared with that established by the switch bank 370 is generated in a counter 380 that is interconnected through a gate 382 to the counter 376. The reset terminal of the counters 376 and 380 receives the control signal $\overline{\text{DS2}}$ from the output of the inverter amplifier 256.

As the leading edge of a bank note enters the detector 118, the control signal $\overline{\text{DS2}}$ is generated to remove the reset of the counters 376 and 380. These counters now accumulate a count signal at the clock frequency generated at the output of the inverter amplifier 366. The accumulated count continues to increase so long as a bill is passing through the detector 118. If the accumulated count reaches the value of the count set by the timing networks 368 and 370, then the indication is that a trailing bill condition exists and a trailing bill divert signal (TBD) is generated on a line 384. The trailing bill divert signal is used to subsequently produce a divert required status signal, requesting that the controller divert bills assembled in the escrow station 18 into the divert bin 176.

Another timing function of FIGS. 4*a* and 4*b* is associated with the multiple bill detector 120. Logic for this timing function includes a counter 386 receiving the clock frequency for the amplifier 366 through a gate 388 that is also connected to receive the control signal DS9 from the output of the inverter amplifier 336. Reset of the counter 386 is controlled by the signal DS2 from the inverter amplifier 264.

The last stage of the decade counter 386 is applied to the C-terminal of a flip-flop 390 whose reset is controlled by the output of a gate 392. One input to the gate 392 is the divert control signal DIV at the output of the inverting amplifier 214 and the second input to this gate is the motor turn on signal $\overline{\text{TMTRON}}$ at the output of the amplifier 204. The Q-terminal of the flip-flop 390 is connected to one input of a divert gate 394.

A second input to the gate 394 is the output of a flip-flop 396 that receives the trailing bundle control signal (TBD) from the counter 374. The reset terminal of the flip-flop 396 is tied to the output of the gate 392. Thus, when either the flip-flop 390 or the flip-flop 396 is set, the gate 394 provides a divert required control signal (DIVREQ) which in turn is used to produce the $\overline{\text{DIVREQ5}}$ status signal previously discussed, which causes the controller to direct the bank notes in the escrow station 18 into the divert bin 176.

Another function of the timing logic of FIGS. 4*a* and 4*b* is to control energization of the solenoid 64. Logic for generating the control signal to the solenoid 64 includes decade counters 398 and 400 connected in series with the clock frequency at the output of the amplifier 366 applied through a gate 402 to the counter 398. The counter 398 interconnects to the counter 400 through a gate 404. The count accumulated in the counters 398 and 400 is controlled by a reset signal generated at the output of an inverter amplifier 406. This amplifier is driven from the output of AND gate 408 that receives at one input the control signal $\overline{\text{DS8}}$ and has a second input connected to the output of AND gate 410. The output of the AND gate 410 is a control signal L2C DRIVEC1 that controls the clutch for the roller 44.

Input signals applied to AND gate 410 are from the output of AND gate 412 and the output of an AND gate 468. The AND gate 412 receives the control signal $\overline{\text{DS2}}$ from the amplifier 256 and the dispense control signal DISP from the amplifier 190. The AND gate 468 receives its inputs from inverter amplifier 416 whose input is the logical OR of DIV and DEL from gate 414 and the output of inverter 470 whose input is L3C from AND gate 434. The OR gate 414 receives the divert control signal DIV from the amplifier 214 and the bundle deliver signal DEL from the output of the amplifier 196. The output of the OR gate 414 is also the control voltage L4C for energizing the solenoid 146 and the control voltage L9C applied to the solenoid for controlling the gate 130.

Removing the reset control from the counters 398 and 400 causes the count value of these counters to increase at the rate of the clock frequency. When this count accumulates to a defined level, a control signal L1C PICKER is applied to activate the solenoid 64 for one-quarter second, causing the continuous belt 48 to move towards the first note in an effort to slide it into the nip of the separating rollers 44 and 46. This action continues for one-quarter second or until a bank note passes the detector 74 which then generates a signal that reapplies the reset to the counters 398 and 400. Should a note fail to be picked, the solenoid 64 will be deactivated for one-quarter second and the process will be repeated.

Another timing function of the logic of FIGS. 4*a* and 4*b* is provided by counters 418, 420 and 422 for controlling the elevator drive motor 20. The clock frequency is applied to the counter 418 through an OR gate 424 that also receives the control signal DS1 from the output of the amplifier 246. The last stage of the counter 418 is interconnected to the counter 420 through a gate 426 and the counter 420 is interconnected to the counter 422 through a gate 428. Each of the reset terminals of the counters 418, 420 and 422 is controlled by the output of an OR gate 430. Gate 430 receives the motor control signal $\overline{\text{TMTRON}}$ from the output of the amplifier 204 and the control signal DS2 from the output of the amplifier 264.

The output of the counter 422 is applied through an inverter amplifier 432 to the input of a NAND gate 434. A second input to the NAND gate 434 is the output of an AND gate 436 that receives the motor control signal TMTRON from the inverter amplifier 212 and the control signal DS1 from amplifier 246. This logic circuitry controls the energization of the clutch associated with the roller 46 for separating multiple bills when more than one bill is detected passing through the double detector 84.

One additional timing function of the circuitry of FIGS. 4*a* and 4*b* is control of the exit clutch and exit brake for the roller 158 of the exit throat transport 104. This timing function is controlled by logic that includes switch banks 438*a* and 440*a* with the former connected to a digital comparator 442 and the latter connected to a digital comparator 444. A binary number used in a comparison in the comparator 442 is generated at the outputs of a counter 446 and the number for comparison in the digital comparator 444 is generated in a counter 448. Each of these counters is reset by the control signal $\overline{\text{DS4}}$ at the output of the amplifier 282. The counter 446 receives the clock frequency through a gate 450 whose other input is connected to the output of the comparator 444. The counters 446 and 448 are interconnected through a gate 452.

When the leading edge of a bundle of bank notes from the escrow station 18 passes through the detector 172, the reset applied to the counters 446 and 448 is removed and these counters respond to the clock frequency to generate an increasing binary number. This binary number is compared in the digital comparators 442 and 444. When the count in the counters 446 and 448 equals a value set by the switch banks 438*a* and 440*a*, an output from the comparator 442 is applied through an inverter amplifier 454 that triggers an AND gate 456 thereby deenergizing the clutch driving the roller 158. The output of the comparator 444 is also applied to an AND gate 458 that energizes the brake for the roller 158. So long as bills remain in the detector 172, the exit clutch for the roller 158 remains deenergized.

The output of the inverter amplifier 454 also controls the reset of counters 460 and 462. The counter 460 is clocked at the frequency at the output of the amplifier 366 through a gate 464 with the counters interconnected through a gate 466. When the reset is removed from the counters 460 and 462 they count up at the clock frequency rate. After a preset time, a control signal is generated from the counter 462 to inhibit the clock frequency from the counters 460 and 462 and also deenergize the exit brake of the roller 158 through an inverter amplifier 468 having an output connected to the AND gate 458.

As the customer removes the bundle from the area of the detector 174, the reset signal is again applied to the counters 446 and 448 and the exit clutch is again energized to drive the roller 158.

With the control system of the present invention, bank notes are dispensed from the storage bin 12 by first turning on the motor 40 to transport bills from the storage bin to the escrow station 18. After the correct number of bank notes has been assembled at the escrow station 18 they are delivered to the exit throat by means of the exit throat transport 104. If a trailing bill condition is detected or a multiple bill condition is detected, the bank notes assembled in the escrow station 18 are diverted into the divert bin 176 by an external controller. To restart a subsequent cycle, signals generated by the detectors 119, 172 and 186 must indicate that no bank notes are in these areas. That is, that there are no bank notes in the escrow station 18, in the exit throat transport 104 or in the divert bin transport 98. Further, a dispense cycle cannot begin unless there are bills on the elevator 10 as determined by the detector 22. Also, the storage bin 12 must be in place before a dispense cycle begins.

During the dispensing of bank notes, multiple bills traveling together are detected at the multiple bill detector 84 and at the multiple bill detector 120. Trailing bills are sensed at the detector 118. Each of these functions ensures the proper number of bills will be dispensed to a customer.

While only one embodiment of the invention, together with modifications thereof, has been described in detail herein and shown in the accompanying drawings, it will be evident that various further modifications are possible without departing from the scope of the invention.

What is claimed is:

1. A method of controlling the dispensing of bank notes from a banking machine responsive to externally generated control signals, comprising the steps of:

feeding back notes from a storage bin along a transport path of a tranport system, returning all but one bank note fed to the transport system back to the storage bin, timing the travel of a bank note past a check point displaced from the start of the transport path of the transport system to monitor for an overlapping note condition, sensing for the presence of multiple notes traveling together through the transport system only after completion of the timing function at a location displaced downstream from the check point along the transport path by a distance such that the bank note has partially passed the location at the completion of the timing function, assembling bank notes delivered from the transport system in an escrow station, and transporting the assembled notes from the escrow station to an exit throat.

2. The method of controlling the dispensing of bank notes as set forth in claim 1 including the step of turning off the transport system when the notes have been partially extended through the exit throat.

3. The method of controlling the dispensing of bank notes as set forth in claim 1 including the step of transporting to a divert bin the notes transported from the escrow station.

4. The method of controlling the dispensing of bank notes as set forth in claim 2 including the step of sensing for the presence of notes at the exit throat, in the escrow station, and in the storage bin prior to actuating the transport system.

5. The method of controlling the dispensing of bank notes as set forth in claim 1 wherein the step of returning notes to the storage bin includes the step of sensing for the presence of multiple notes at the entrance to the transport system.

6. A method of controlling the dispensing of bank notes from a banking machine responsive to externally generated control signals, comprising the steps of:

actuating a transport system for delivering bank notes along a transport path from a storage bin to an escrow station, detecting the movement of multiple notes along the transport path in the transport system and generating a separating signal when more than one note enters the transport system, returning all but one note in the transport system in response to the separating signal bank to the storage bin, timing the travel of a note past a check point displaced from the start of the transport path of the transport system to monitor for an overlapping bill condition, sensing for the presence of multiple notes traveling together through the transport system only after completion of the timing function at a location displaced downstream from the check point along the transport path by a distance such that the bank note has partially passed the location at the completion of the timing function, and transporting notes assembled at the escrow station to an exit throat.

7. The method of controlling the dispensing of bank notes as set forth in claim 6 wherein the step of transporting notes assembled in the escrow station includes sensing the presence of notes at the exit throat to deactivate the transport system.

8. The method of controlling the dispensing of bank notes as set forth in claim 7 including the step of braking the transport system when notes have been partially extended through the exit throat.

9. Apparatus for controlling the dispensing of bank notes from a banking machine responsive to externally generated control signals, comprising in combination:

transport means for delivering notes from a storage bin along a transport path to an escrow station, means for feeding notes from the storage bin to the transport path of the transport means, means for sensing the movement of a note along the transport path of said transport means to generate a note timing and note count signal, a multiple note detector located downstream of said means for sensing along the transport path by a distance less than the length of a back note and responsive to the note timing signal to sense multiple notes traveling together through the transport means and generate a divert signal for a multiple note condition, and means for transporting notes assembled in the escrow station to an exit throat at the termination of the note count signal whenever the multiple note detector does not generate the divert signal.

10. Apparatus for controlling the dispensing of bank notes as set forth in claim 9 including a second multiple note detector responsive to the movement of notes at the entrance to said transport means to generate a separating signal when more than one note enters the transport means, and means responsive to the separating signal to return all but one note fed to the transport means back to the storage bin.

11. Apparatus for controlling the dispensing of bank notes as set forth in claim 9 including means for diverting the notes assembled in the escrow station to a divert bin when the number of assembled notes exceeds a selected number.

12. Appartus for controlling the dispensing of bank notes as set forth in claim 9 including means for diverting the notes assembled in the escrow station to a divert bin when the multiple note detector generates a divert signal.

13. Apparatus for controlling the dispensing of bank notes as set forth in claim 12 including means for assembling notes in the escrow station as delivered by said transport means.

14. Apparatus for controlling the dispensing of bank notes as set forth in claim 13 including means for diverting the notes assembled in the escrow station to a divert bin when the note count signal exceeds a selected level or the multiple note detector generates a divert required signal.

15. Apparatus for controlling the dispensing of bank notes as set forth in claim 14 wherein said means for diverting includes a divert gate actuated when the note count signal exceeds the selected level or the multiple note detector generates a divert required signal.

16. Apparatus for controlling the dispensing of bank notes as set forth in claim 15 wherein said means for diverting further includes means for transporting notes diverted by said divert gate into the divert bin.

17. Apparatus for controlling the dispensing of bank notes as set forth in claim 9 including means for sensing the presence of notes at the exit throat to deenergize and brake said transport means.

18. Apparatus for controlling the dispensing of bank notes from a banking machine responsive to externally generated control signals, comprising in combination:

transport means for delivering bank notes from a storage bin along a transport path to an escrow station, means responsive to multiple notes entering said transport means to return all but one note back to the storage bin, means for sensing the movement of a note along the transport path of said transport means to generate a note timing and note count signal, a multiple note detector located downstream of said means for sensing along the transport path by a distance less than the length of a bank note and responsive to the note timing signal to sense multiple notes traveling together through the transport means and generate a divert required signal for a multiple note condition, and means for transporting notes assembled in the escrow station to an exit throat if the multiple note detector does not sense multiple notes traveling together.

19. Apparatus for controlling the dispensing of bank notes as set forth in claim 18 including means for sensing the presence of notes at the exit throat, means for sensing notes in the escrow station, and means for sensing the presence of notes in the storage bin, each of said means for sensing generating a status check signal to control the operation of said transport means.

* * * * *

UNITED STATES PATENT AND TRADEMARK OFFICE

CERTIFICATE OF CORRECTION

PATENT NO. : 4,159,782

DATED : July 3, 1979

INVENTOR(S) : Robert F. Swartzendruber

It is certified that error appears in the above-identified patent and that said Letters Patent are hereby corrected as shown below:

Column 9, line 2, change "348" to --340--.

Column 12, line 46, change "back" to --bank--.
Column 13, line 60 change "back" to --bank--.

Signed and Sealed this

*Eighth* Day of *January 1980*

[SEAL]

*Attest:*

SIDNEY A. DIAMOND

*Attesting Officer* *Commissioner of Patents and Trademarks*